US006648539B2

(12) United States Patent
Dai

(10) Patent No.: US 6,648,539 B2
(45) Date of Patent: Nov. 18, 2003

(54) FREE INK WRITING INSTRUMENT WITH NANO TECHNOLOGY

(75) Inventor: Zhao Zhang Dai, Shen Zhen (CN)

(73) Assignee: Toyo Pen International Ltd., Chai Wan (HK)

( * ) Notice: Subject to any disclaimer, the term of this patent is extended or adjusted under 35 U.S.C. 154(b) by 0 days.

(21) Appl. No.: 10/151,043

(22) Filed: May 21, 2002

(65) Prior Publication Data

US 2002/0172544 A1 Nov. 21, 2002

(30) Foreign Application Priority Data

May 21, 2001 (CN) ..... 01235948 U

(51) Int. Cl.[7] ..... B43K 5/00; B43K 7/02

(52) U.S. Cl. ..... 401/198; 401/199; 401/217; 401/224

(58) Field of Search ..... 401/198, 199, 401/196, 217, 224, 242

(56) References Cited

U.S. PATENT DOCUMENTS

| | | | | | |
|---|---|---|---|---|---|
| 3,352,622 | A | * | 11/1967 | Schachter | 401/217 |
| 3,446,564 | A | * | 5/1969 | Horie | 401/217 |
| 3,698,825 | A | * | 10/1972 | Sears et al. | 401/217 |
| 4,108,559 | A | * | 8/1978 | Dick et al. | 401/217 |
| 6,503,016 | B2 | * | 1/2003 | Raps et al. | 401/198 |

* cited by examiner

*Primary Examiner*—David J. Walczak
(74) *Attorney, Agent, or Firm*—Rabin & Berdo, P.C.

(57) ABSTRACT

A writing instrument has a housing containing an ink reservoir. The writing instrument further has a writing nib in communication with one (or both) end of the ink reservoir by an ink induction device. In connection with the ink reservoir, there is also at least one set of pressure balance system. The pressure balance system includes a nano hydrophobic venting material that allows air to flow in and out of the reservoir to compensate pressure differential between ambient atmosphere and the interior of the ink reservoir, while prevents ink to flow from the ink reservoir to the atmosphere.

14 Claims, 9 Drawing Sheets

FREE INK WRITING INSTRUMENT WITH NANO TECHNOLOGY

FIELD OF INVENTION

The present invention relates generally to a writing instrument. More specifically, this invention relates to a free ink writing instrument that permits smooth flow of ink when in use and prevents leaking by using nano-technology.

BACKGROUND OF THE INVENTION

Writing instruments are widely used in daily life with various functions and designs. Besides the common pencils, ball point pens and fountain pens, there is a type of pen having a free ink direct supply system, such as a pen having a relatively large nib that is used for marking/drawing, e.g., markers, sign pens.

Such a pen typically includes a penholder having an ink reservoir therein, and a marking tip which draws ink from the ink reservoir by capillary action. However, in the pen, as the ink in the ink reservoir is consumed, the pressure in the ink reservoir drops and air must be accordingly introduced therein. If the air cannot enter the ink reservoir to relieve the pressure difference, the ink flow may be interrupted. On the other hand, if the air in the ink reservoir expands due to changes in temperature, atmospheric pressure, and the like, the ink may drip/leak from the marking tip.

In order to control the pressure in the ink reservoir, one solution is to provide an air venting system in the pen that controls air pressure, so as to provide a steady flow of ink when writing and to prevent the pen from leaking ink. Conventionally, such an air venting system is formed by use of a piston, a valve or a capillary structure. However, such an air venting system has a relatively complicated structure. Further, the pen with such an air venting system can easily malfunction and has an unsatisfactory writing outcome, i.e., unstable ink flow and/or ink leakage when writing.

As the problem of pressure balance cannot be well solved, other methods also have been widely used in the industry. For instance, a marking pen may contain a fibrous core that absorbs and holds ink, and a nib in communication with the fibrous core to obtain an ink supply, so that it can be used for writing purposes. The nib is formed from a fiber capable of performing capillary action. However, such pen normally uses a poor performance fibrous core to hold the ink, thus affecting the ink flow and causing waste of the ink.

Therefore, there is a need to provide a free ink writing instrument that permits a smooth flow of ink and prevents leaking with an improved pressure balance system. In addition, the writing instrument has a relatively reasonable cost in manufacturing.

SUMMARY OF THE INVENTION

To overcome the limitations of the related art described above, and to overcome other limitations that will become apparent upon reading and understanding the present specification, this invention is directed to a writing instrument for smooth ink flow and/or against dripping/leaking. The writing instrument of the present invention uses nano technology, i.e., nano hydrophobic venting material, to permit air flow into and out of the ink reservoir to control pressure balance between the ambient atmosphere and the interior of the reservoir while preventing ink leaking to the atmosphere. Thus, the writing instrument can have a continuous steady flow of ink without leaking.

In one embodiment, the writing instrument includes a housing means containing an ink reservoir therein, a writing nib in communication with one end of the ink reservoir, and a pressure balance system in connection with the other end of the ink reservoir. The pressure balance system has a nano hydrophobic venting sheet that permits air flow into and out of the reservoir to compensate pressure differentials between the ambient atmosphere and the interior of the reservoir, and prevents ink flow from the reservoir to the atmosphere.

Further, in one embodiment, the pressure balance system includes a control valve, a washer, the nano hydrophobic venting sheet and a vent-plug arranged in that order. The control valve is in communication with the reservoir, and allows air flow and blocks ink leaking from the rear end of the housing. The vent-plug is used for venting the reservoir to atmosphere. With the high performance of the nano hydrophobic venting sheet, the pressure balance system maintains pressure balance between the interior of the reservoir and ambient atmosphere in various situations (e.g., changes in temperature/atmosphere pressure, ink consumption, etc.). Thus, the writing instrument having a smooth ink flow without leaking/dripping can be obtained.

Further, in one embodiment, the writing instrument has at least one writing nib, each of which draws ink from the reservoir through one ink guiding system. Also, each writing nib further couples to one pressure balance system for air venting.

Yet, in one embodiment, the pressure balance system further includes an air duct, a vent block, and a vent-plug disposed within the vent block. Air in the reservoir communicates with atmosphere through the air duct, the vent block and the vent-plug.

Furthermore, in one embodiment, the writing nib has a fibrous tip or a metal tip.

Moreover, in one embodiment, the writing instrument includes a cap fitting with the housing. The cap surrounds the writing nib and forms an air tight seal when in sealing engagement with the housing.

A variety of additional advantages of the invention will be set forth in part in the description which follows, and in part will be obvious from the description, or may be learned by practice of the invention. Various advantages of the invention will be realized and attained by means of the elements and combinations particularly point out in the claims. It is to be understood that both the foregoing general description and the following detailed description are exemplary and explanatory only and are not restrictive of the invention as claimed.

DETAILED DESCRIPTION OF THE PREFERRED EMBODIMENT

In the following description of the specific embodiments, reference is made to the accompanying drawings which form a part hereof, and in which is shown by way of illustration the specific embodiments in which the invention may be practiced. It is to be understood that other embodiments may be utilized as structural changes may be made without departing from the scope of the present invention.

This invention provides a writing instrument that permits a continuous steady flow of ink and prevents ink leakage. In one embodiment, the writing instrument comprises a housing with an ink reservoir therein, a writing nib in communication with one end of the ink reservoir, and a pressure balance system in communication with the other end of the ink reservoir. The pressure balance system uses nanotechnology, i.e., a nano hydrophobic venting sheet, to allow air to flow into and out of the reservoir while preventing ink leakage, so as to maintain a pressure balance between the ambient atmosphere and the interior of the reservoir and to prevent ink leakage to the atmosphere. Thus, a writing instrument with a smooth ink flow and no ink leakage can be obtained.

Figure 1:
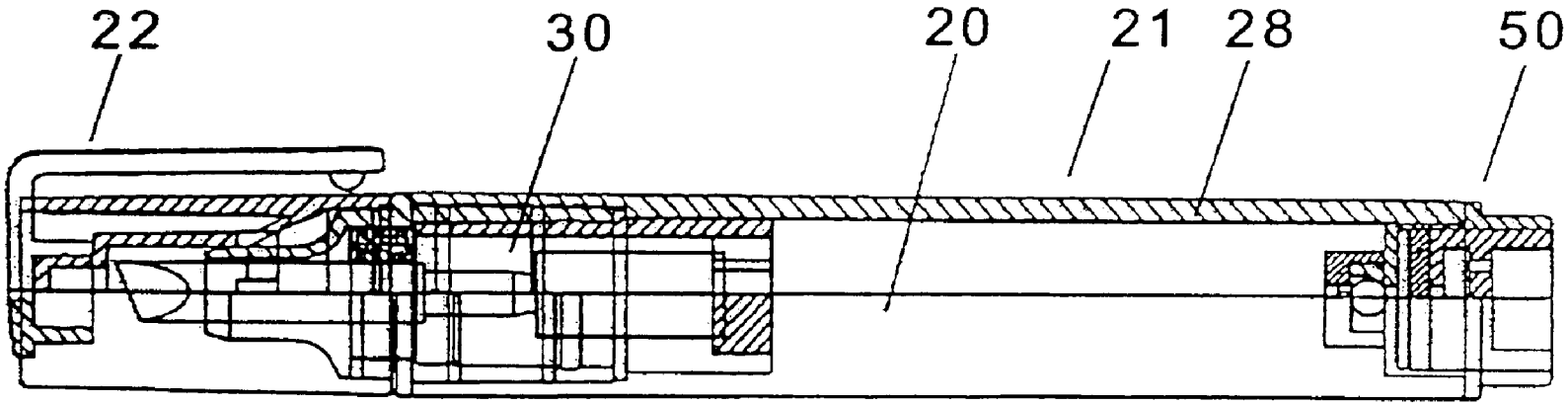
FIG. 1 shows a longitudinal cross section view of a writing instrument according to one embodiment of the present invention.
Figure 2:
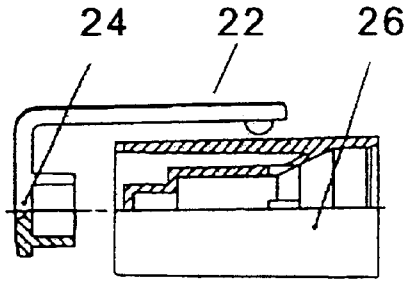
FIG. 2 shows structure of a cap of the writing instrument according to one embodiment of the present invention.

Referring now to the drawings, FIG. 1 illustrates a writing instrument 20 according to one embodiment of the present invention. The writing instrument 20 has a cap 22 in sealing engagement with a penholder 21. As shown in FIG. 2, the cap 22 includes a clip section 24 and a cap body 26. The clip section 24 fits in the cap body 26 to provide a sealing end. When the cap 22 engages with the penholder 21 (see FIG. 1), the cap 22 surrounds a nib and forms an air tight seal to prevent drying of the nib. Also, the cap 22 serves to protect the nib from damage and to make certain that ink from the nib does not inadvertently stain unintended surfaces. It is appreciated that caps with various shapes and/or structures other than the cap 22 shown in FIG. 2 also can be used.

Figure 4:
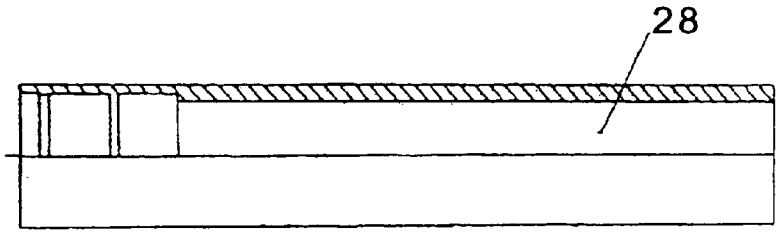
FIG. 4 shows a housing means of the writing instrument according to one embodiment of the present invention.

The penholder 21 has housing means 28 (see FIG. 4) defining an ink reservoir for storing ink. The ink reservoir can store ink such as fluorescent ink, marker ink, board ink and correction fluid. A nib section 30 attaches to a front end of the housing 28 and communicates with one end of the ink reservoir. A pressure balance system 50 affixes to a rear end of the housing 28 and connects with the other end of the ink reservoir.

Figure 3:
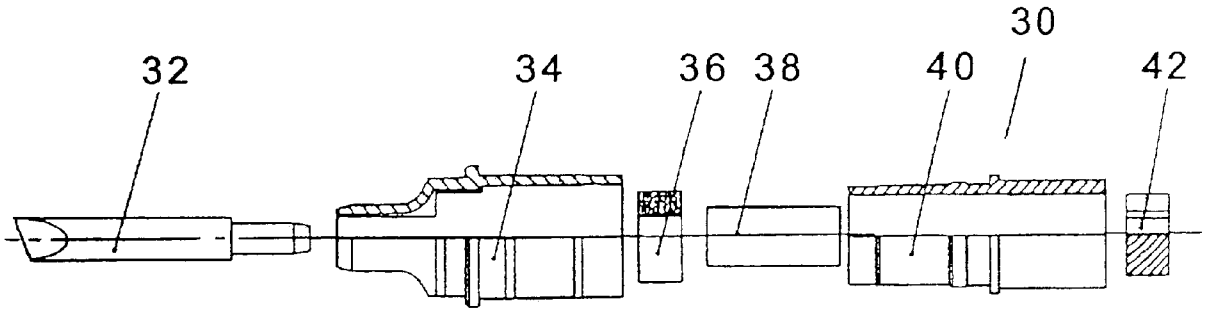
FIG. 3 shows structure of an ink guiding system and a writing nib of the writing instrument arranged in that order according to one embodiment of the present invention.

The nib section 30 of FIG. 3 has a nib 32 partly held in a nib holder 34. The exposed part of the nib 32 defines a writing tip to transfer ink to a recording medium such as paper. The nib 32 is formed from a fiber capable of performing capillary action. The nib section 30 further includes an adsorption ring 36, and a core tube 40 that contains a fibrous core 38 therein. A plug 42 is fitted into one end of the core tube 40 connecting to the fibrous core 38. The plug 42 has openings that allow ink flow from the reservoir to the fibrous core 38. The core tube 40 couples into the nib holder 34 so that the fibrous core 38 within the core tube 40 communicates with one end of the nib 32. Thus, an ink flow passage is formed in which ink reaches the tip of the nib 32 from the ink reservoir through the plug 42, the fibrous core 38 and the nib 32. In this embodiment, the nib section 30 acts as an ink guiding system to draw ink from the ink reservoir to the writing tip.

Figure 5:
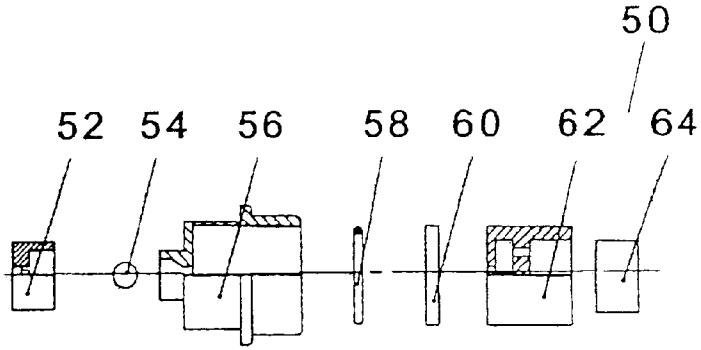
FIG. 5 shows structure of a pressure balance system of the writing instrument arranged in that order according to one embodiment of the present invention.
Figure 6:
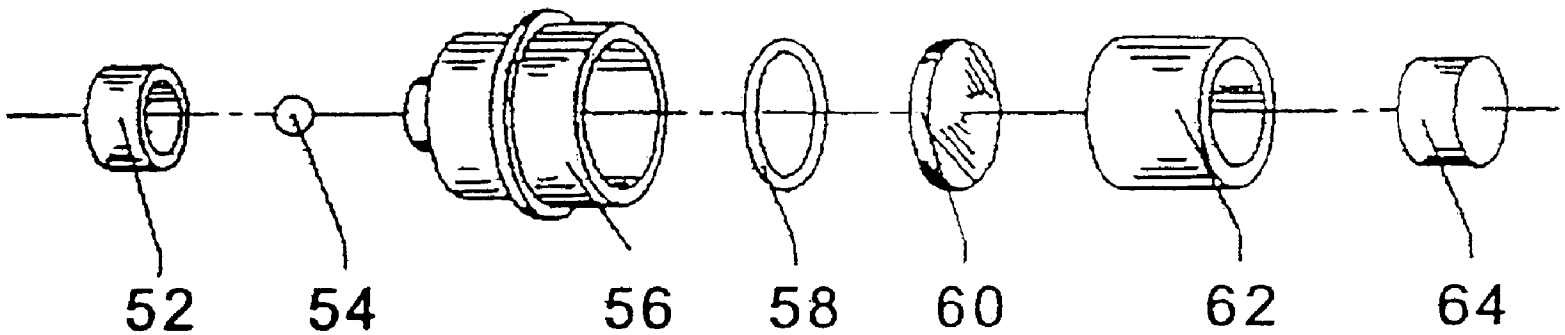
FIG. 6 shows a perspective view of a pressure balance system of the writing instrument arranged in that order according to one embodiment of the present invention.

At the rear end, the pressure balance system 50 is attached to the housing 28 to provide air venting. As shown in FIGS. 5 and 6, the pressure balance system 50 has a one-way control valve (including a valve body 52, a valve ball 54 and a valve seat 56) in connection with the ink reservoir that allows air flow and blocks ink leaking from the reservoir. The valve body 52 and the valve seat 56 form a valve chamber that allows the valve ball 54 to move therein. The control valve is in an opened position when the valve ball 54 is spaced from the valve seat 56, and in a closed position when the valve ball 54 sits on the valve seat 56. A washer 58, a nano hydrophobic venting sheet 60, a vent-plug 62 and a dust-proof cover 64 are disposed within the valve seat 56 in that order. The nano hydrophobic venting sheet 60 uses nano technology and has characteristics that permit air to pass freely therethrough and prevent ink penetration. The vent-plug 62 is used for venting the reservoir to the atmosphere.

When the air pressure in the ink reservoir drops (e.g., ink is drawn out of the ink reservoir), air is introduced into the ink reservoir via the pressure balance system 50, i.e., through the nano hydrophobic venting sheet 60, so as to relieve the pressure difference. When air pressure in the ink reservoir expands (e.g., increase in temperature), air in the ink reservoir can flow out of the reservoir through the nano hydrophobic venting sheet 60 to the atmosphere. In any occasion, pressure in the ink reservoir changes in response to that of the ambient atmosphere, thus maintaining pressure balance between the ambient atmosphere and the interior of the reservoir. In addition, the nano hydrophobic venting sheet 60 prevents ink penetration therethrough. Thus, ink in the reservoir cannot be infiltrated to the atmosphere. Accordingly, a writing instrument using nano technology (nano hydrophobic venting sheet) can have a continuous steady flow of ink without leaking.

The nano hydrophobic venting sheet is obtained by introducing super dual ability hydrophobic nano technology into a venting material. Thus, the material has a good performance in hydrophobicity and ventilation.

Figure 7:
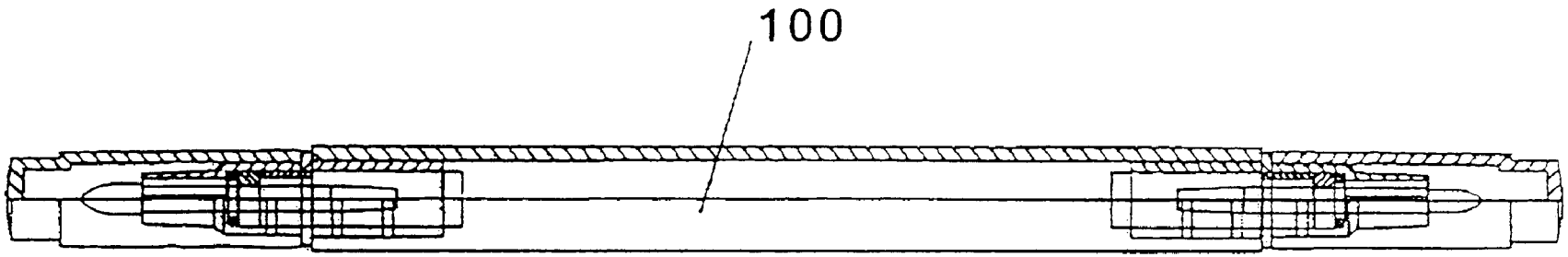
FIG. 7 shows a longitudinal cross section view of a writing instrument according to a second embodiment of the present invention.
Figure 8:
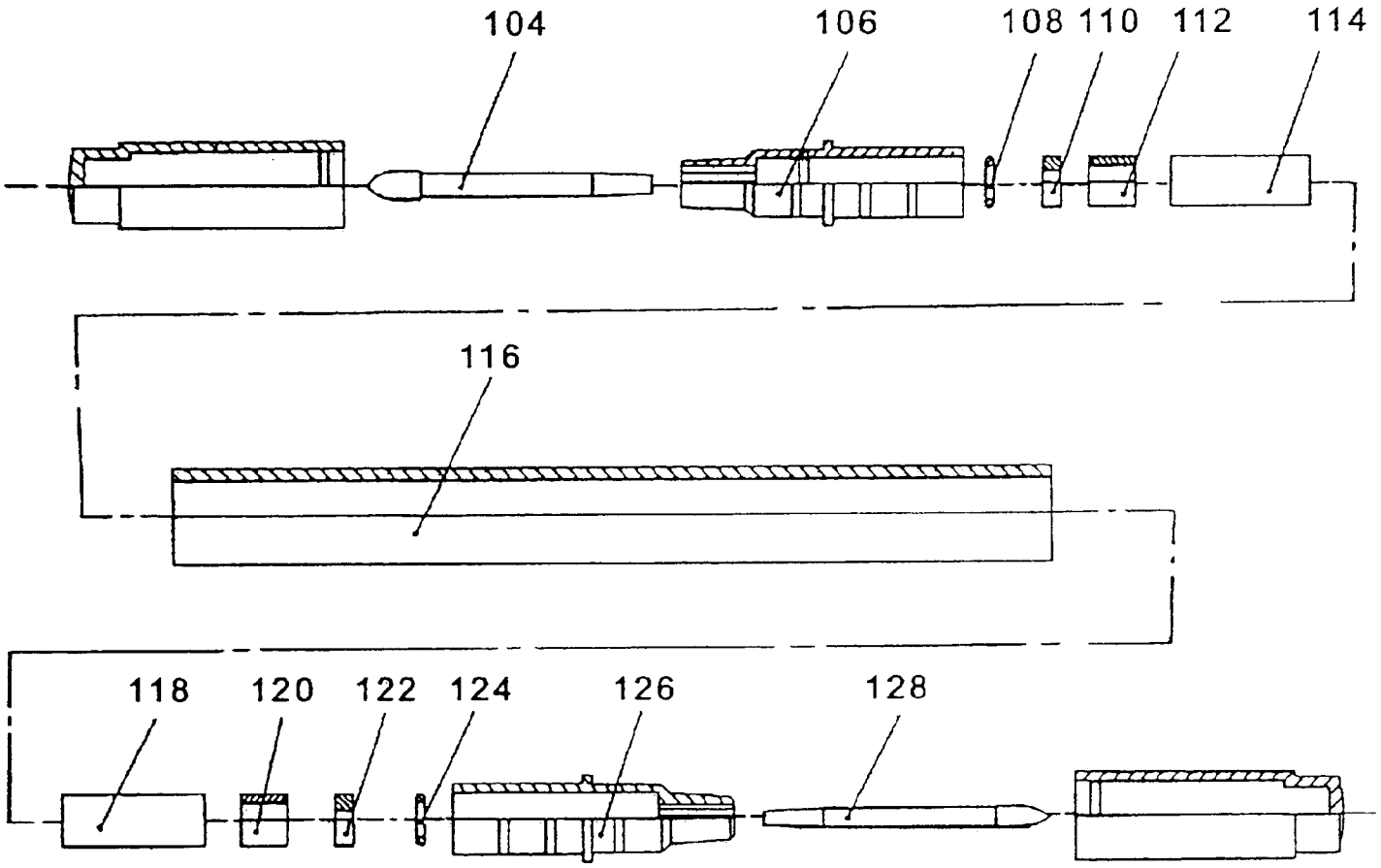
FIG. 8 shows structure of the writing instrument according to the second embodiment of the present invention.
Figure 9:
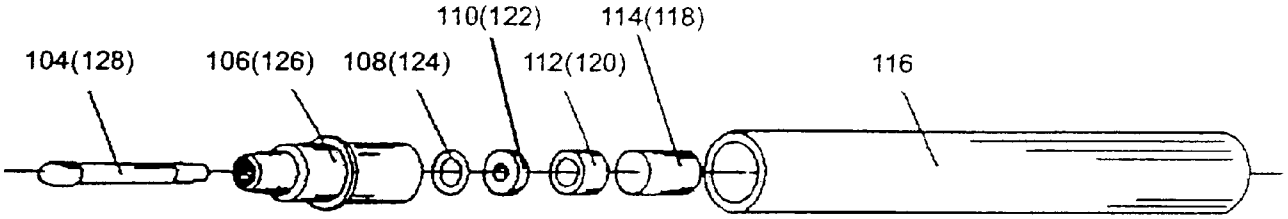
FIG. 9 shows a perspective view of a pressure balance system of the writing instrument according to the second embodiment of the present invention.

FIGS. 7–9 illustrate a writing instrument 100 according to a second embodiment of the present invention. The writing instrument 100 has dual writing nibs (104, 128), which may be different in size and/or flexibility. The writing instrument further includes a penholder 116 defining an ink reservoir. The ink reservoir can store ink such as fluorescent ink, marker ink, board ink and correction fluid. The writing nib (104, 128) draws ink from the reservoir via nib holder (106, 126) and fibrous core (114, 118), which define an ink guiding system. As shown in FIG. 8, the writing nib is inserted into the nib holder (106, 126) and is connected to fibrous core (114, 118) through a pressure balance system that is formed by a sealed washer (108, 124), a nano hydrophobic venting sheet (110, 122) and a press ring (112,120). The writing nib (104, 128) fits into the nib holder with several ventholes for air venting. Air is allowed to flow into and out of the reservoir through the pressure balance system, i.e., the sealed washer (108, 124), the nano hydrophobic venting sheet (110, 122) and the press ring (112, 120).

Figure 10:
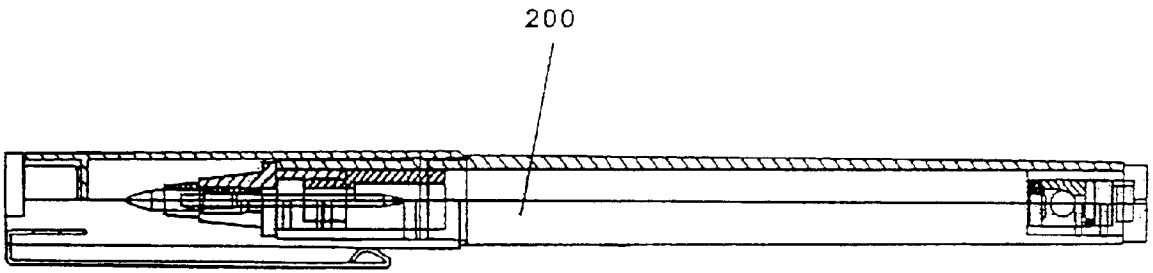
FIG. 10 shows a longitudinal cross section view of a writing instrument according to a third embodiment of the present invention.
Figure 11:
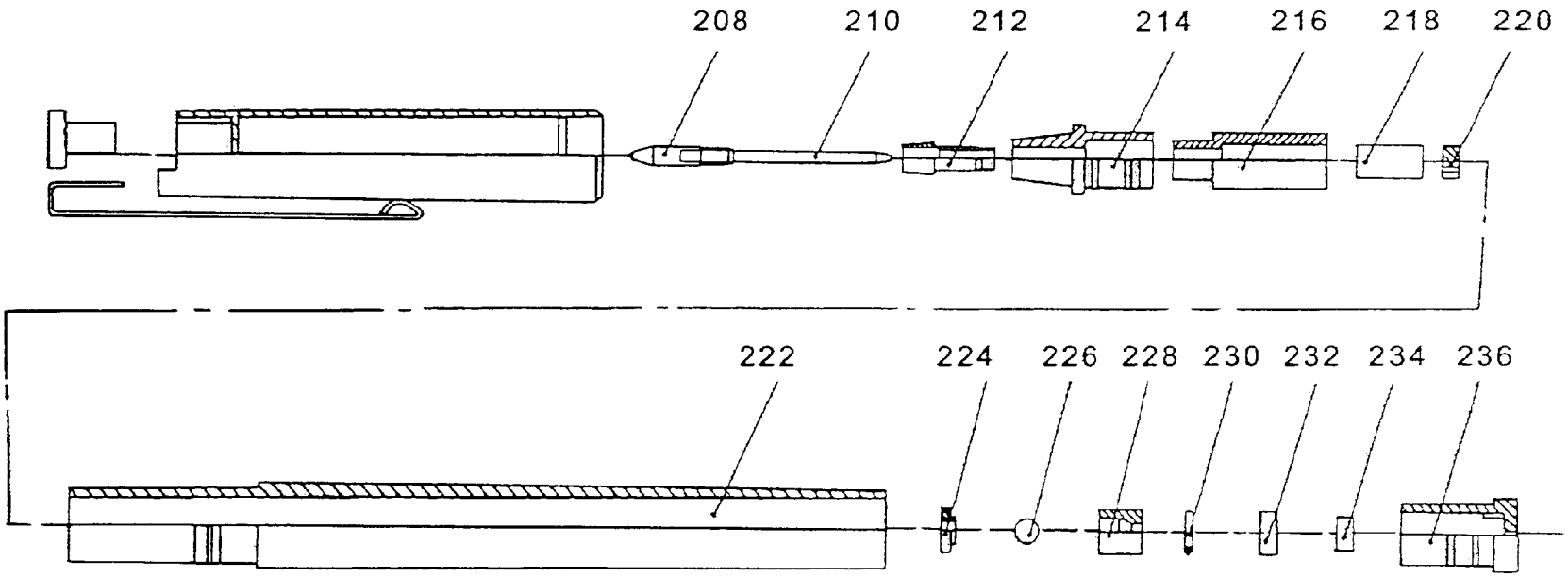
FIG. 11 shows structure of the writing instrument according to the third embodiment of the present invention.

FIGS. 10–11 illustrate a writing instrument 200 according to a third embodiment of the present invention. The writing instrument 200 includes a penholder 222 defining an ink reservoir, which can store various inks, e.g., fluorescent ink, marker ink, board ink and correction fluid, etc. At one end of the penholder 222, a writing nib 208 having a metal tip is connected to an ink guiding system to draw ink from the reservoir. The ink guiding system includes a fibrous stick 210, a tip cover 212, a nib holder 214, a core tube 216, a fibrous core 218 and a plug 220 with openings arranged in that order. It is to be understood that the fibrous stick 210, the core tube 216, the fibrous core 218 and the plug 220 may not be needed when the reservoir stores gel ink or correction fluid. At the other end of the penholder 222, a one-way control valve (including valve body 224, valve ball 226 and valve seat 228), a washer 230, a nano hydrophobic venting sheet 232, a dust-proof cover 234 and a vent-plug 236 define a pressure balance system. The principle of the pressure balance system of this embodiment is similar to that of the first embodiment, and thus no detailed description will be provided here.

Figure 12:
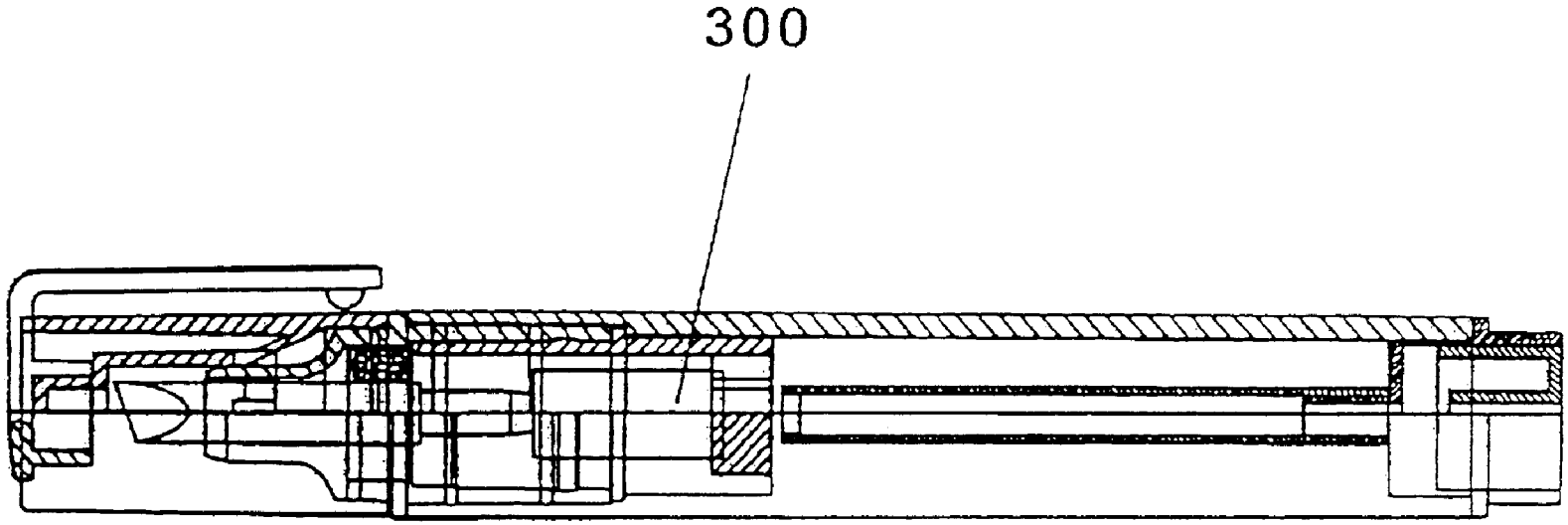
FIG. 12 shows a longitudinal cross section view of a writing instrument according to a fourth embodiment of the present invention.
Figure 13:
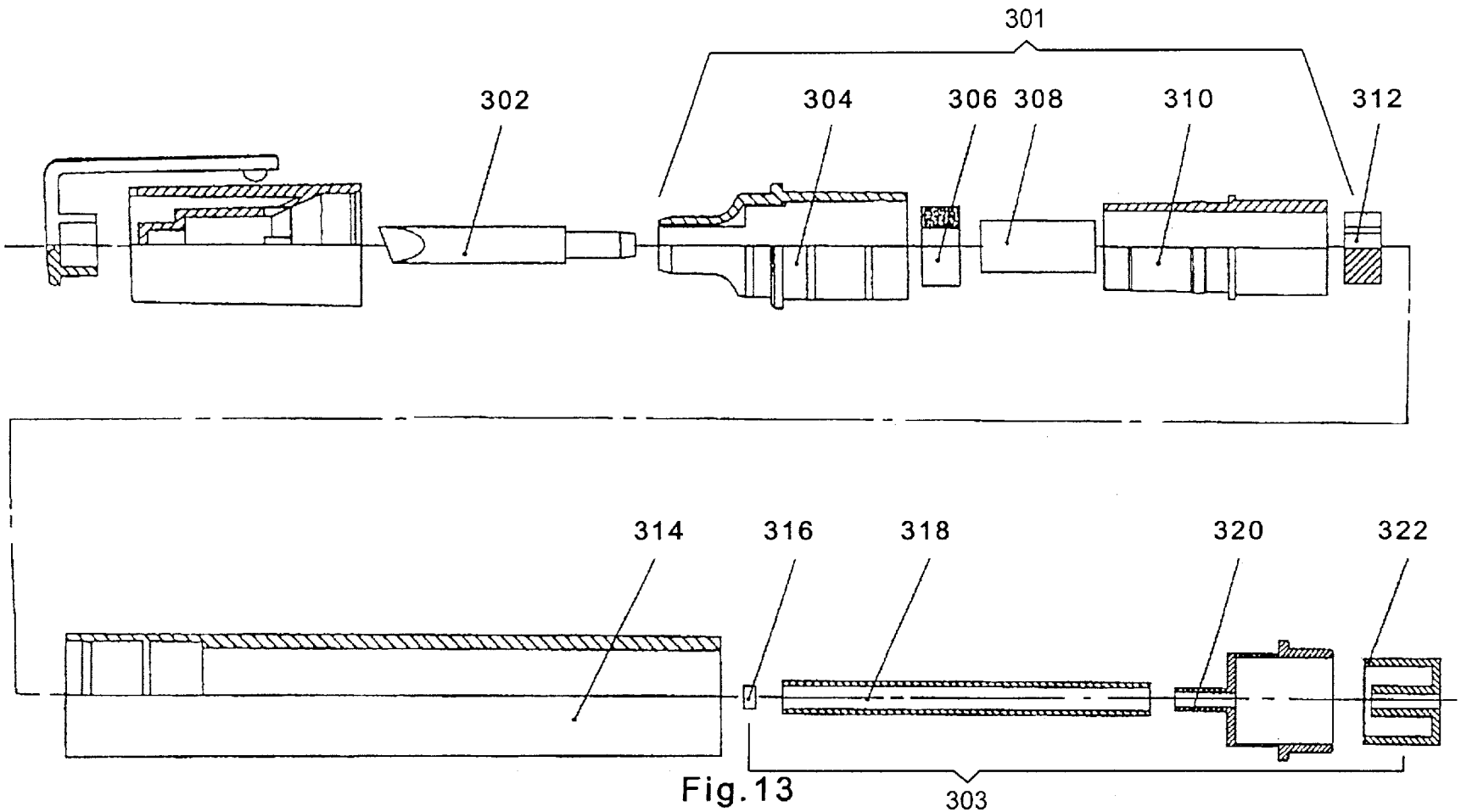
FIG. 13 shows structure of the writing instrument according to the fourth embodiment of the present invention.

FIGS. 12–13 illustrate a writing instrument 300 according to a fourth embodiment of the present invention. The writing instrument 300 has a penholder 314 defining an ink reservoir. At the front end of the penholder 314, a writing nib 302 is connected to an ink guiding system 301 to draw ink from the reservoir. The ink guiding system 301 has a similar structure as that of the first embodiment, including a nib holder 304, an adsorption ring 306, a fibrous core 308, a core tube 310 and a plug with openings 312. At the rear end of the penholder 314, a nano hydrophobic venting sheet 316, an air duct 318, a vent block 320 and a vent-plug 322 define a pressure balance system 303. The air duct 318 is inserted into the penholder 314, having one end coupled to the nano hydrophobic venting sheet 316 and the other end coupled to the vent block 320. The vent-plug 322 is plugged into the vent block 320. In this embodiment, air in the reservoir passes through the nano hydrophobic venting sheet 316 and enters the air duct 318, so as to communicate with the atmosphere. With such arrangement, no control valve is needed.

It is to be understood that this invention can be used in writing instruments having various forms by using a nano hydrophobic venting material. The nano hydrophobic venting material is obtained by introducing super dual ability hydrophobic nano technology into a venting material, for a favorable performance in hydrophobicity and ventilation.

It is also to be understood that the writing nib of a writing instrument in this invention can have a fibrous tip or a metal tip.

The foregoing description of the preferred embodiment of the invention has been presented for the purposes of illustration and description. It is no intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A writing instrument, comprising:

a housing having a reservoir therein for containing ink in a free-flowing state;

a writing nib secured with respect to a front end of the housing, and in communication with the reservoir for drawing ink from the reservoir to a writing medium; and a pressure balance system attached to a rear end of the housing, and in communication with the reservoir for venting the reservoir to atmosphere, the pressure balance system having a nano hydrophobic venting material that uses super dual ability hydrophobic nano technology, for preventing ink flow from the reservoir to the atmosphere, and permitting air flow into and out of the reservoir to compensate for pressure differentials between the atmosphere and an interior of the reservoir, wherein the pressure balance system further includes a control valve comprising a valve body, a valve ball and a valve seat, and a washer, a vent-plug and a dust-proof cover positioned within the valve seat in that order; the nano hydrophobic venting material being positioned between the washer and the vent-plug.

2. The writing instrument as claimed in claim 1, wherein the control valve is in communication with the reservoir, the control valve having an opened position when the valve ball is spaced from the valve seat, and a closed position when the valve ball is fitted onto the valve seat, so as to allow air flow and to block ink leakage from the rear end of the housing.

3. A writing instrument, comprising:

a housing having a reservoir therein for containing ink in a free-flowing state;

a writing nib secured with respect to a front end of the housing, and in communication with the reservoir for drawing ink from the reservoir to a writing medium;

a pressure balance system attached to a rear end of the housing, and in communication with the reservoir for venting the reservoir to atmosphere, the pressure balance system having a nano hydrophobic venting material for preventing ink flow from the reservoir to the atmosphere, and permitting air flow into and out of the reservoir to compensate for pressure differentials between the atmosphere and an interior of the reservoir; and an ink guiding system connected to the reservoir for drawing ink from the reservoir to the writing medium; the ink guiding system having a core tube containing a fibrous core therein that connects to the writing nib at one end, and a plug with openings fitting into the core tube in connection with the fibrous core at the other end; ink in the reservoir being capable of entering into the fibrous core through the plug openings, and then reaching the writing nib via the fibrous core.

4. The writing instrument as claimed in claim 3, wherein the writing instrument further includes a cap corresponding to the housing, the cap surrounding the writing nib and forming an air tight seal when in sealing engagement with the housing.

5. A writing instrument, comprising:

a housing having a reservoir therein for containing ink in a free-flowing state;

at least one writing nib at an end of the housing;

an ink guiding system having a first end connected to the writing nib, and having a second end coupled to the reservoir for drawing ink from the reservoir to the writing nib, the ink guiding system including a nib holder, and a fibrous core, a core tube and a plug with openings, positioned in that order and coupled to the nib holder, the writing nib being inserted into the nib holder to draw ink from the reservoir; and a pressure balance system coupled to the reservoir for venting the reservoir to atmosphere, the pressure balance system having a nano hydrophobic venting material for preventing ink flow from the reservoir to the atmosphere, and permitting air flow into and out of the reservoir to compensate for pressure differentials between the atmosphere and an interior of the reservoir, the pressure balance system further having a control valve having a valve body, a valve ball and a valve seat, and a washer, a vent-plug, and a dust-proof cover positioned in that order within the valve seat; the nano hydrophobic venting material being placed between the washer and the vent-plug.

6. The writing instrument as claimed in claim 5, wherein the writing nib has a fibrous tip.

7. A writing instrument, comprising:

a housing having a reservoir therein for containing ink in a free-flowing state;

at least one writing nib at an end of the housing;

an ink guiding system having a first end connected to the writing nib, and having a second end connected to the reservoir for drawing ink from the reservoir to the writing nib; and a pressure balance system coupled with the reservoir for venting the reservoir to atmosphere, the pressure balance system having a nano hydrophobic venting material for preventing ink flow from the reservoir to the atmosphere, and permitting air flow into and out of the reservoir to compensate for pressure differentials between the atmosphere and an interior of the reservoir;

wherein the ink guiding system includes a nib holder and a fibrous core therein and being coupled to one end of the reservoir;

wherein the pressure balance system is disposed within the nib holder, and further includes a sealed washer and a press ring, the nano hydrophobic venting material being disposed therebetween; and wherein the at least one writing nib is inserted into the nib holder through the sealed washer, the nano hydrophobic venting material and the press ring, and is connected to the fibrous core.

8. The writing instrument as claimed in claim 7, wherein the writing nib has a fibrous tip.

9. A writing instrument, comprising:

a housing having a reservoir therein for containing ink in a free-flowing state;

at least one writing nib at an end of the housing;

an ink guiding system having a first end connected to the writing nib, and having a second end connected to the reservoir for drawing ink from the reservoir to the writing nib; and a pressure balance system coupled with the reservoir for venting the reservoir to atmosphere, the pressure balance system having a nano hydrophobic venting material for preventing ink flow from the reservoir to the atmosphere, and permitting air flow into and out of the reservoir to compensate for pressure differentials between the atmosphere and an interior of the reservoir;

wherein the ink guiding system includes a nib holder and a tip cover connected to one end of the nib holder, the writing nib being connected to another end of the tip cover, the nib holder being connected to the reservoir; and wherein the pressure balance system further includes a control valve, a washer, a dust-proof cover and a vent-plug connected in that order, the nano hydrophobic venting material being disposed between the washer and the dust-proof cover.

10. The writing instrument as claimed in claim 9, wherein the writing nib has a metal tip.

11. A writing instrument, comprising:

a housing having a reservoir therein for containing ink in a free-flowing state;

at least one writing nib at an end of the housing;

an ink guiding system having a first end connected to the writing nib, and having a second end connected to the reservoir for drawing ink from the reservoir to the writing nib; and a pressure balance system coupled with the reservoir for venting the reservoir to atmosphere, the pressure balance system having a nano hydrophobic venting material for preventing ink flow from the reservoir to the atmosphere, and permitting air flow into and out of the reservoir to compensate for pressure differentials between the atmosphere and an interior of the reservoir;

wherein the ink guiding system includes a fibrous stick, a tip cover, a nib holder, a core tube, a fibrous core and a plug with openings, connected in that order, the writing nib being connected to the nib holder through the tip cover, the nib holder being connected to the reservoir; and wherein the pressure balance system includes a control valve, a washer, a dust-proof cover and a vent-plug connected in that order, the nano hydrophobic venting material being placed between the washer and the dust-proof cover.

12. The writing instrument as claimed in claim 11, wherein the writing nib has a metal tip.

13. A writing instrument, comprising:

a housing having a reservoir therein for containing ink in a free-flowing state;

at least one writing nib at an end of the housing;

an ink guiding system having a first end connected to the writing nib, and having a second end connected to the reservoir for drawing ink from the reservoir to the writing nib; and a pressure balance system coupled with the reservoir for venting the reservoir to atmosphere, the pressure balance system having a nano hydrophobic venting material for preventing ink flow from the reservoir to the atmosphere, and permitting air flow into and out of the reservoir to compensate for pressure differentials between the atmosphere and an interior of the reservoir;

wherein the ink guiding system includes a nib holder, a fibrous core, a core tube containing the fibrous core, and a plug with openings, the core tube with the fibrous core therein being connected to the reservoir, the writing nib being inserted into the nib holder and connected to the fibrous core; and wherein the pressure balance system further includes an air duct, the air duct having one end coupled to the nano hydrophobic venting material and another end coupled to a vent block containing a vent-plug therein.

14. The writing instrument as claimed in claim 13, wherein the writing nib has a fibrous tip.

* * * * *